US005607100A

United States Patent [19]

Stenner

[11] Patent Number: 5,607,100

[45] Date of Patent: Mar. 4, 1997

[54] DIRECT MAIL PACKET WITH PLURALITY OF DETACHABLY JOINED ENVELOPES AND METHOD OF MANUFACTURE

[75] Inventor: John W. Stenner, Orange, Conn.

[73] Assignee: Kurt H. Volk, Inc., Milford, Conn.

[21] Appl. No.: 289,800

[22] Filed: Aug. 12, 1994

[51] Int. Cl.[6] ..... B65D 27/10

[52] U.S. Cl. ..... 229/69; 229/72; 229/92.8

[58] Field of Search ..... 229/72, 69, 92.1, 229/92.8, 300, 301, 303, 305

[56] References Cited

U.S. PATENT DOCUMENTS

| | | | |
|---|---|---|---|
| 443,141 | 12/1890 | Kittredge . | |
| 693,624 | 2/1902 | Sallade . | |
| 761,912 | 6/1904 | Rheutan . | |
| 1,016,149 | 1/1912 | Henson . | |
| 1,089,486 | 3/1914 | Levine . | |
| 1,576,576 | 3/1926 | Connolly | 229/69 X |
| 2,001,489 | 4/1935 | Elbaum . | |
| 2,181,212 | 11/1939 | Smith | 229/69 |
| 2,517,843 | 8/1950 | Cochran . | |
| 2,759,658 | 8/1956 | Sawdon . | |
| 3,557,519 | 1/1971 | Lyon, Jr. . | |
| 3,718,277 | 2/1973 | Volkert | 229/301 |
| 3,883,069 | 5/1975 | Volkert | 229/69 X |
| 4,067,171 | 1/1978 | Herbert et al. . | |
| 4,284,230 | 8/1981 | Schultz | 229/92.1 X |
| 4,437,852 | 3/1984 | Volk, Jr. et al. . | |
| 4,543,082 | 9/1985 | Stenner . | |
| 4,724,996 | 2/1988 | Everett | 229/301 |
| 4,731,142 | 3/1988 | Stenner | 229/72 X |
| 4,830,269 | 5/1989 | Jenkins . | |
| 4,852,795 | 8/1989 | Volk, Jr. | 229/72 X |
| 4,860,945 | 8/1989 | Breen . | |
| 4,896,823 | 1/1990 | Taylor | 229/303 |
| 5,125,562 | 6/1992 | Bendel . | |
| 5,271,554 | 12/1993 | Sauerwine . | |

*Primary Examiner*—Jes F. Pascua
*Attorney, Agent, or Firm*—Abelman, Frayne & Schwab

[57] ABSTRACT

A direct mail article in the form of a packet comprising a plurality of envelopes separably joined along a parting line at their longitudinal edges, as by perforations, each envelope containing at least one separate enclosure device, one or more of which envelopes and enclosure devices can be personalized, is produced from an integral web or sheet defining all of the envelopes and at least one of the separate enclosure devices. The direct mail packet is formed by folding the envelopes at the parting lines to position the envelopes one above the other. In one preferred embodiment, the direct mail article is formed from two webs, one of which defines all of the envelopes and an associated enclosure device for each envelope, and the second web defines one or more additional enclosure devices for at least one of the plurality of envelopes, the enclosures not being separated until after both have been folded into the envelope, thus ensuring that mismatching of personalized enclosures and envelopes does not occur.

11 Claims, 6 Drawing Sheets

DIRECT MAIL PACKET WITH PLURALITY OF DETACHABLY JOINED ENVELOPES AND METHOD OF MANUFACTURE

BACKGROUND OF THE INVENTION

1. Field of the Invention

This invention relates to direct mail articles and commercial methods for preparing large numbers of such articles, each of which comprises a plurality of envelopes containing one or more separate enclosures.

2. Description of the Related Art

The present invention represents an advance in the direct mail art disclosed, for example, in U.S. Pat. Nos. 3,557,519 and 4,067,171. In U.S. Pat. No. 3,557,519, the disclosure of which is incorporated by reference, there is disclosed a method of preparing an addressed envelope containing a single separate personalized lettersheet from an integral combination envelope-lettersheet that can be part of a continuous web. U.S. Pat. No. 4,067,171, the disclosure of which is incorporated by reference, discloses a method of making a multiple-enclosure mailer comprising a personalized envelope containing a plurality of separate personalized enclosures such as letter sheets, forms, return-mail applications and the like, which are prepared from two or more separate integral composite sheets. The two or more sheets are temporarily bonded in a mated configuration by crimping or gluing along a portion of the longitudinal edges of the sheets after they are form printed. The joining of the sheets in this manner eliminates mismatching of personalized sheets that had troubled the direct mail industry. The sheets remain joined along their longitudinal edge portions during further processing steps. Prior to insertion into the envelope packet that is formed by folding the envelope section, the joined edge portions are trimmed away to separate the sheets from one another. The sheets are cut along a transverse fold line prior to sealing the envelope flap to provide a plurality of separate personalized enclosures.

The terms "personalized" and "personalization" as used throughout this description will be understood by those familiar with the art to include information regarding the recipient's name, address, gender, age, and other data which may be collected from demographic studies.

As will be appreciated by those skilled in the art, the special handling required for the insertion of one or more enclosures into the envelopes adds significantly to the overall cost of a direct mail campaign or program, and particularly to the expense of larger campaigns which typically can involve the mailing of a million or more articles.

SUMMARY OF THE INVENTION

The present invention provides direct mail articles and commercial methods for producing such articles that comprise a plurality of separably joined envelopes, and preferably three or more envelopes, and at least one separate enclosure device, and preferably a plurality of such enclosure devices in each of the envelopes. All of the envelopes and at least one of the separate enclosures in each of the envelopes are produced from an integral web or sheet.

In a further preferred embodiment one or more of the envelopes and enclosures are personalized during the printing of the integral web or sheets from which the finished envelopes and enclosure devices are produced.

The enclosure devices can take the form of a lettersheet, a reply device, such as an order form, a business reply postcard and/or a business reply envelope.

In a preferred embodiment of the invention, at least one of the plurality of envelopes and one or more of the enclosure devices are personalized.

The envelopes and their respective enclosure devices can also be made from two or more separate webs of continuous, pre-printed material that are brought together in a superposed mating relation prior to the further finishing steps that precede the separation of the enclosure devices from each other and from the envelopes.

In one preferred embodiment, the method of the invention broadly contemplates the steps of joining in a mated configuration a first form printed integral sheet of letter weight paper stock from which a plurality of envelopes and associated separate enclosure devices are subsequently formed, and a second form printed integral sheet of paper from which a plurality of enclosure devices are formed, joining the lateral edges of the respective front and back panel portions of the plurality of envelope sections and, while the envelope flaps are open, separating the respective enclosure sheets to produce a plurality of finished envelopes in a side-by-side array, (i.e., joined at their edges), each envelope containing a plurality of separate enclosure devices and each envelope separably joined to the other along a longitudinal parting line at the adjoining edge.

A mailing article having a greater number of enclosures can be produced by including one or more additional enclosure sheet sections between or adjacent the first and second integral sheet sections prior to the folding and gluing step which forms the envelope pocket. Alternatively, a different number of enclosure devices can be included in one or more of the plurality of separably joined envelopes by changing the number of webs mated with the envelope-integral enclosure sheet of the first web.

A series of perforations is provided along each longitudinal parting line between adjacent envelopes to permit their eventual separation by the recipient. The envelopes are then folded at the parting lines to a superposed position to form a packet suitable for mailing. In order to permit the plurality of envelopes containing enclosures to be folded into a compact packet, the width of the envelopes, as defined by the distance between the longitudinal fold lines, can be varied. The envelopes can be fan-folded or folded inwardly upon themselves. In order to ensure the integrity of the folded packet, releasable adhesive can be applied to the faces of adjacent superposed envelopes, or edge sealing means, such as sealing wafers, can be applied.

The invention has particular utility where a mass market direct mailing involving up to a million, or more articles having essentially the same format are to be addressed and mailed to individual recipients. Large volume mailings of this type are typically undertaken on behalf of businesses conducting promotions, insurance companies offering alternative types of policies, and the like. Similar mailings might be undertaken by governmental organizations or political sub-divisions in connection with taxation, licensing or registration functions that require periodic payments or the submission of informational reports on a quarterly or other regular basis.

The disclosed method has the particular advantage of providing for the rapid preparation of large numbers of direct mail articles, each of which comprises a plurality of detachably or separably joined envelopes having at least one separate enclosure device (which can optionally be personalized), such as a lettersheet, personalized reply card, a reply device and/or a business reply envelope. Because all of the elements comprising the finished article can be printed on an integral web or sheet mismatching of the personalized enclosure sheets and reply devices is eliminated.

For example, should a government agency require periodic responses (e.g., tax payments) from a large number of individuals, the method of the invention can be employed to transmit a packet comprising a plurality of separably joined envelopes, one of which can be a sealed envelope containing a personalized instruction or advice letter, along with a plurality of return envelopes, detachably joined, each printed with the agency's address and containing a payment form with the individual's name and address printed thereon. After the required information is incorporated onto the appropriate enclosure by the recipient, one of the envelopes is detached and sent back to the agency for processing. Since the returned envelope and enclosure includes the individual's preprinted name and address, potential problems concerning the identity of the individual and legibility of handwriting are avoided. The use of a form printed reply envelopes, which also can be postage paid, improves the likelihood of a prompt response by the recipient.

The methods of the invention can readily be adapted to producing the direct mail articles desired in a variety of sizes and formats which are within the capabilities of commercial lithographic and computer directed printers, and of the folding and converting equipment which is available in the art.

Additional specific uses and advantages of the various formats which can be embodied in the direct mail articles and methods of the invention will be apparent to those familiar with the art in view of the further teachings and description of this specification.

BRIEF DESCRIPTION OF THE DRAWINGS

In the drawings accompanying and forming part of this specification.

In the drawings accompanying and forming part of this specification.

DETAILED DESCRIPTION OF THE PREFERRED EMBODIMENTS

Figure 1:
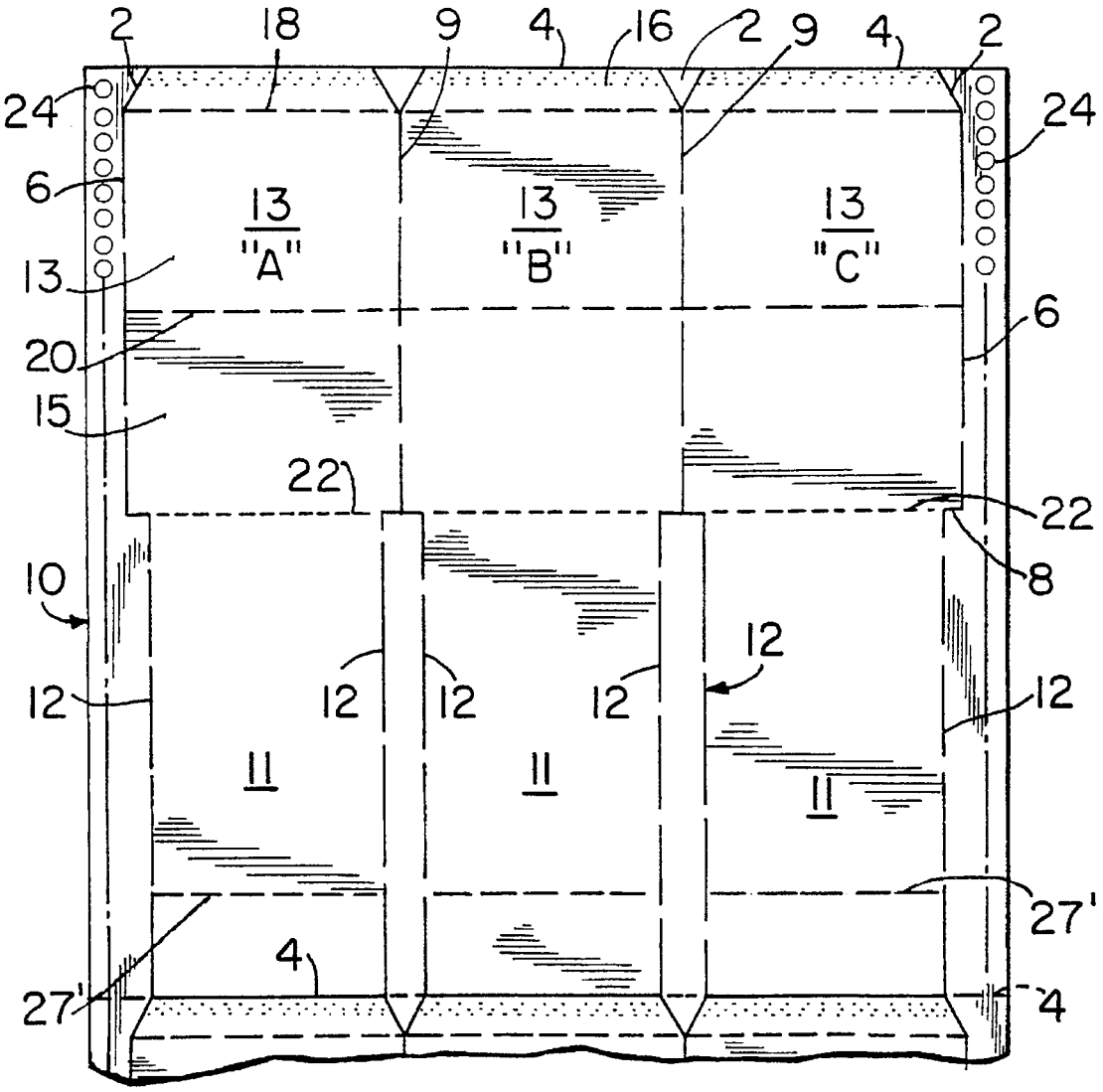
FIG. 1 is a plan view showing a section of the continuous web containing a plurality of the integral envelope and enclosure device sheets for use in the present invention.

Referring to the drawings in detail, wherein like reference characters designate corresponding parts throughout the several figures, and particularly to FIG. 1, there is shown a composite sheet 10 that is divided by transverse line 22 into an enclosure device sheet 11 and an integral envelope sheet 13.

Longitudinal lines 9 divide the composite sheet 10 into a plurality of envelope sheets, which number three in the embodiment illustrated. However, composite sheet 10 can be of a greater width to accommodate four, six or even more envelope sheets.

Composite sheet 10 is a continuous form, preferably a lithographic webbing, having a plurality of sheets 10 defined by transverse lines 4. This form is adapted to be used with a machine such as a high-speed computerized printing machine that utilizes the continuous sheet forms and is optionally provided with a sprocket for high speed feeding of the composite sheet 10 into the machine utilizing said sheets. The composite sheet 10 has longitudinal perforations 12 inside of and generally parallel to punched line holes 24 suitable for engaging sprocket feeding rollers. The enclosure sheet is joined to the envelope sheet 13 contains a first transverse score line 18, which defines the envelope flap 2, and a second transverse score line 20 which defines the front and back of the envelope 13. Envelope flap 2 is provided with remoistenable adhesive 16.

The composite sheet 10 can be a printed lithographic web containing the graphic features previously described. The punched line holes 24 along the outer edge can be die-cut as can be the envelope flap side edges 2 and the perforated lines 6, 12 and 22. Such die-cutting facilitates the removal of these parts after the computer personalization process; however, it should be noted that any of lines 2, 6 and 12, in addition to die-cutting, can be guillotine-cut or slit during finishing. Line 22 also serves as a guide in the first fold of the enclosure sheet 11.

The scored line 18 facilitates folding of the envelope flap. The area identified by 16 is preferably covered with a rewettable gum, and it is an optional feature depending on the type of envelope sealing equipment to be used in the final flap closure of the envelope and whether or not additional material is to be added to the assembled envelopes. This scoring and application of adhesive is accomplished on the web press during printing.

Figure 2:
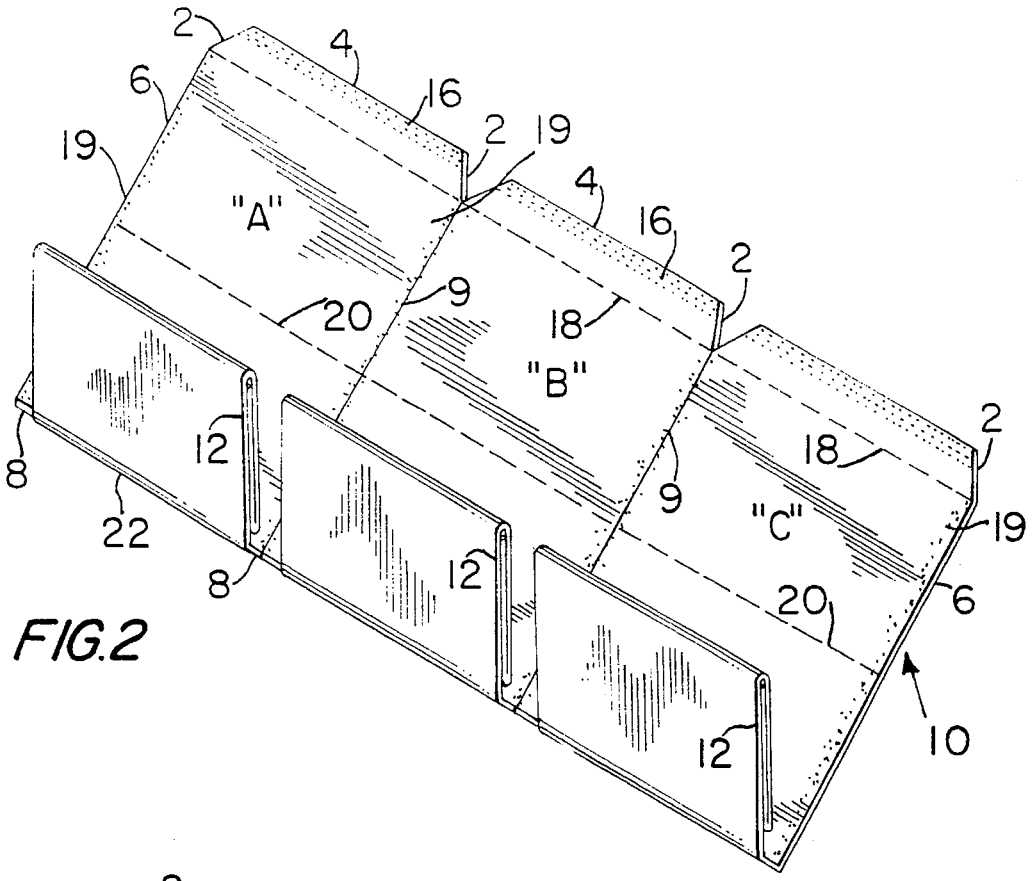
FIG. 2 is a front perspective view of a plurality of the joined envelopes and enclosures of FIG. 1 showing the envelopes in a partially folded position prior to separation from the enclosure device.

Folding the envelope enclosure device after the web has been printed and personalized and after the web edges 2, 6 and the areas defined by lines 4, 22 and 12 lying outside the enclosure sheets 11 have been mechanically stripped away, is preferably accomplished by first "bursting" or separating the sheets of the web into multiples of the desired length and guillotine cutting lines 4. Referring to FIG. 2, the trimmed sheets 10 are then fed through a folding machine which folds the enclosure device sheet 11, and then folds the envelope section 13 around the already folded enclosure device sheet.

Figure 3:
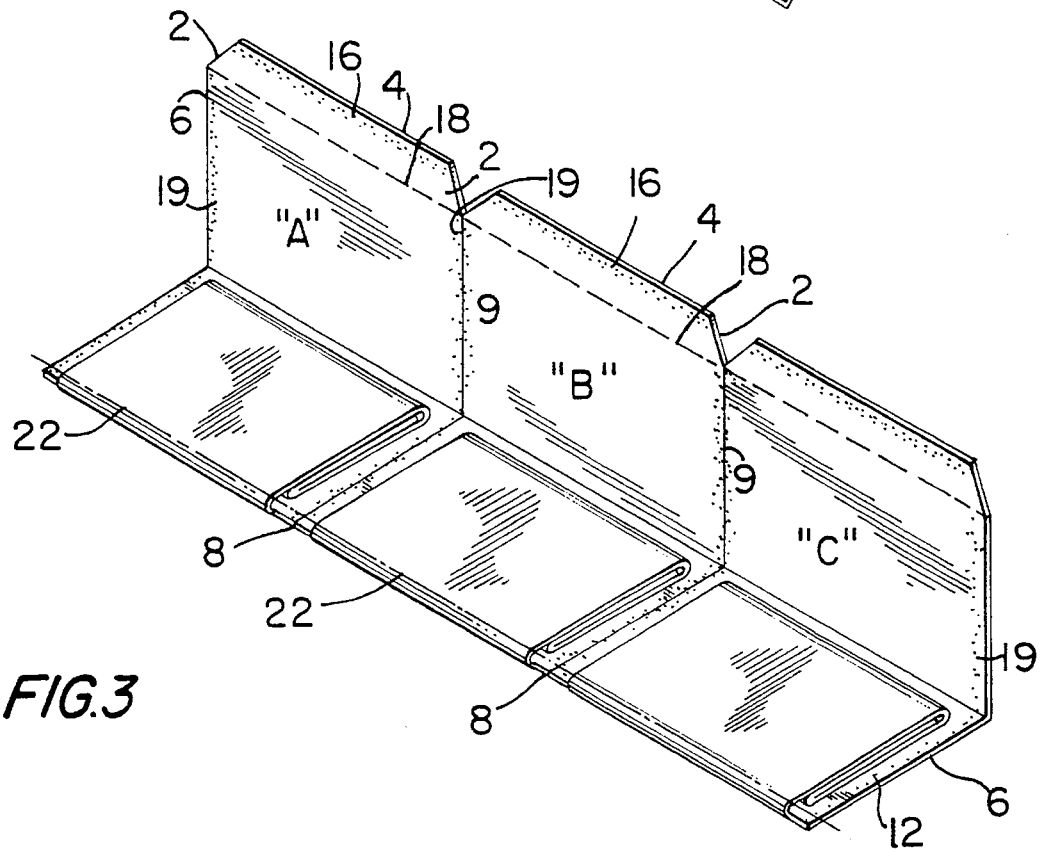
FIG. 3 is a front perspective view of the article of FIG. 2 in nearly completed form ready for separation of the enclosure devices from their associated envelopes.

Referring to FIG. 3, prior to folding, adhesive 19 is applied to sheet 13 along the edges 6 and parting lines 9 so that when each of the envelopes is folded around the attached enclosure(s), edges 6 and parting lines 9 are joined to form the envelope pocket. Adhesive 19 can advantageously be applied using a stitching applicator.

Figure 4A:
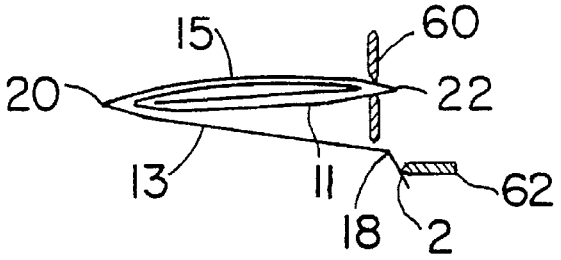
FIGS. 4A and 4B are sectional schematic end views of two embodiments of the articles produced according to the invention showing the separation of the enclosure device(s) from the rear panel of the envelope prior to sealing the envelope flap.

As shown in FIG. 4A, the folded enclosures 11 are then separated from the envelopes 13 along line 22 with a cutting device, such as a scissor wheel 60 or an anvil and slitting blade which is adjusted to the thickness of the paper stock so that the top layers are trimmed clean, while the envelope flap 16 is contacted by deflection bar 62 so that it is untouched. The closure of the envelope flap can be accomplished as an integral part of the separation of the letter enclosure from the envelope or by the use of conventional envelope sealing equipment if additional material is to be added to the envelope.

Figure 5:
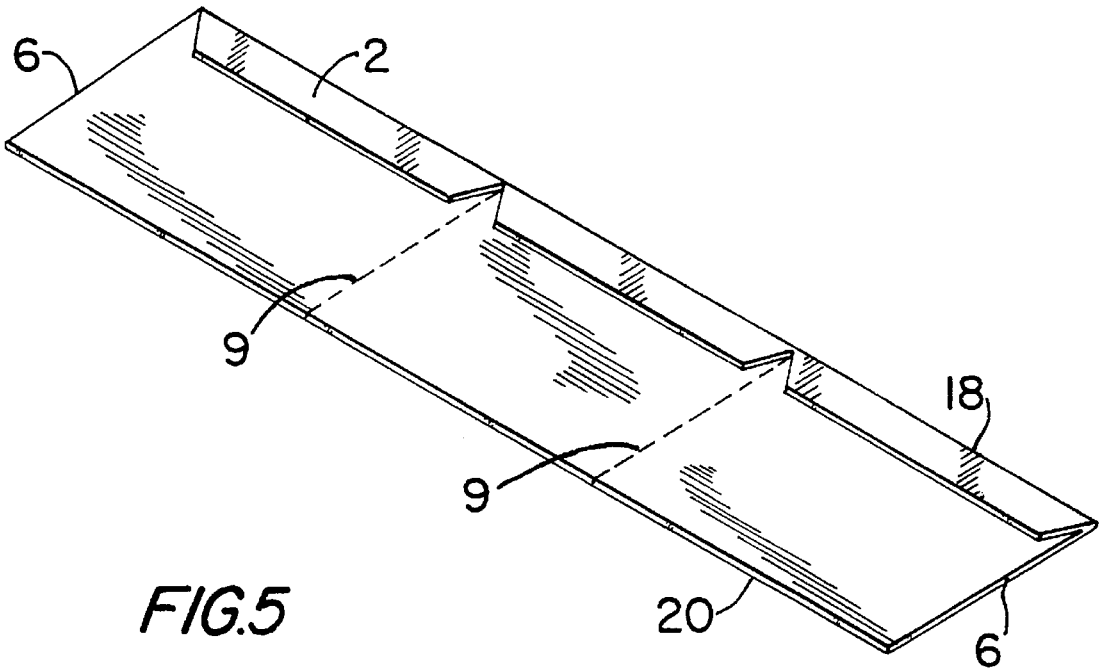
FIG. 5 is a perspective view of the finished envelopes separably joined along perforation lines 9.

In a preferred embodiment of the method, parting lines 9 are perforated during the die-cutting and scoring steps before the first folding step. Alternatively, parting lines 9 are perforated from the head to the foot of the envelope, as shown in FIG. 5, following folding and gluing of the edges of the envelopes along lines 6 and 9.

In an alternative to the single folded envelope/sheet illustrated in FIGS. 2 and 3, sheets 11 can be folded to position lower fold line 27', shown in FIG. 1 to a position overlying fold line 22. When the enclosure sheet and envelope panel are separated along line 22, as described in FIG. 4A, a second separate enclosure is formed in each envelope.

Figure 6A:
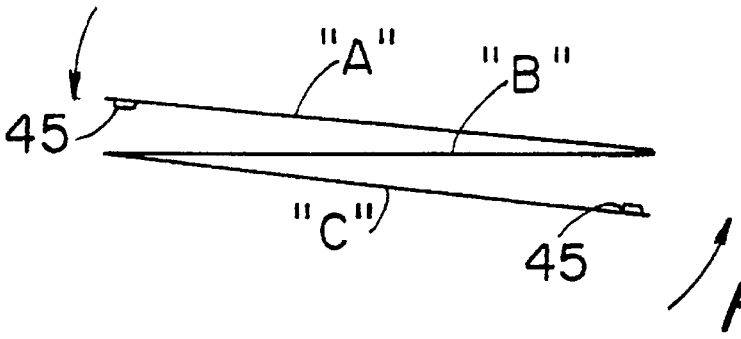
FIGS. 6A and 6B are schematic side views of the article of FIG. 3 showing alternative folding configurations of the finished direct mail packet.
Figure 6B:
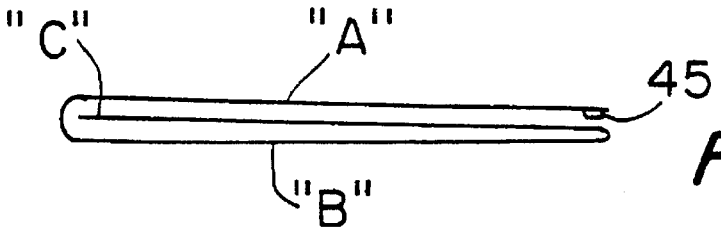
Figure 7:
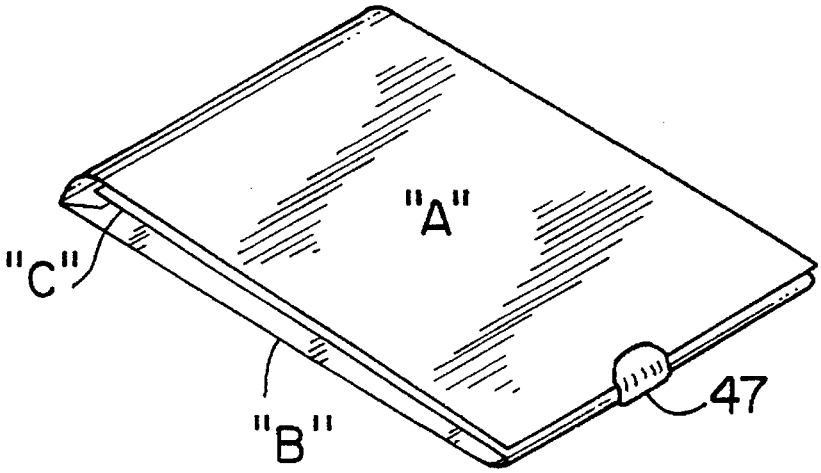
FIG. 7 is a perspective view illustrating an alternative embodiment for sealing the finished packet.

As shown in FIGS. 6A and 6B, the envelopes can be fan folded on an accordion folding machine or folded in one upon the other. For additional security, releasable adhesive 45 can be applied to facing panels of the superposed envelopes to complete the direct mail packet. Alternatively, as shown in FIG. 7, a paper or plastic wafer seal 47, or similar adhesive means can be used to securely seal the packet and prevent tampering with the envelopes or their contents, as when one or more of the envelope flaps are not sealed.

Figure 8B:
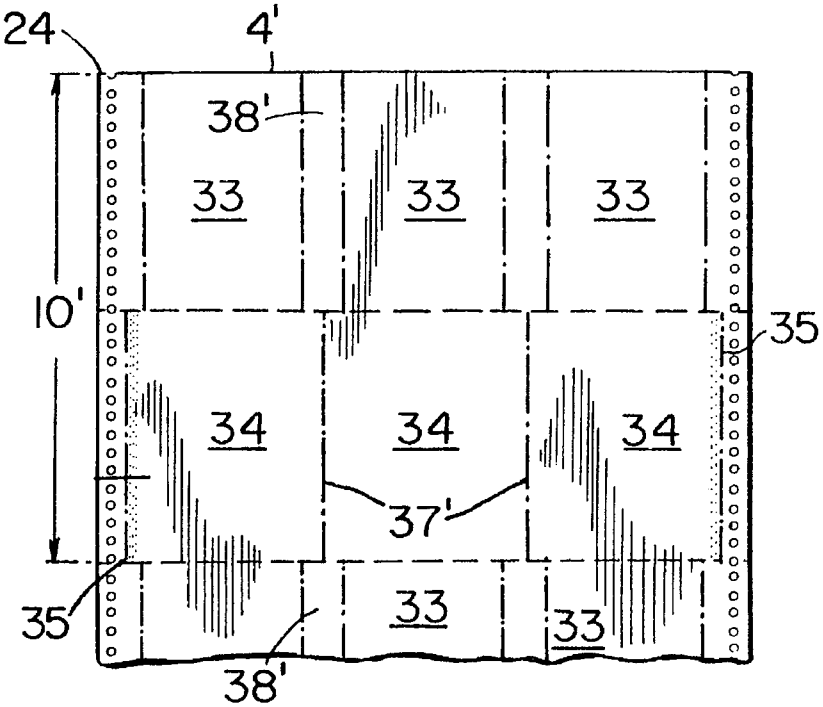
FIGS. 8A and 8B are plan views showing a section of two continuous webs containing a plurality of sections for preparing another embodiment of the invention.
Figure 8A:
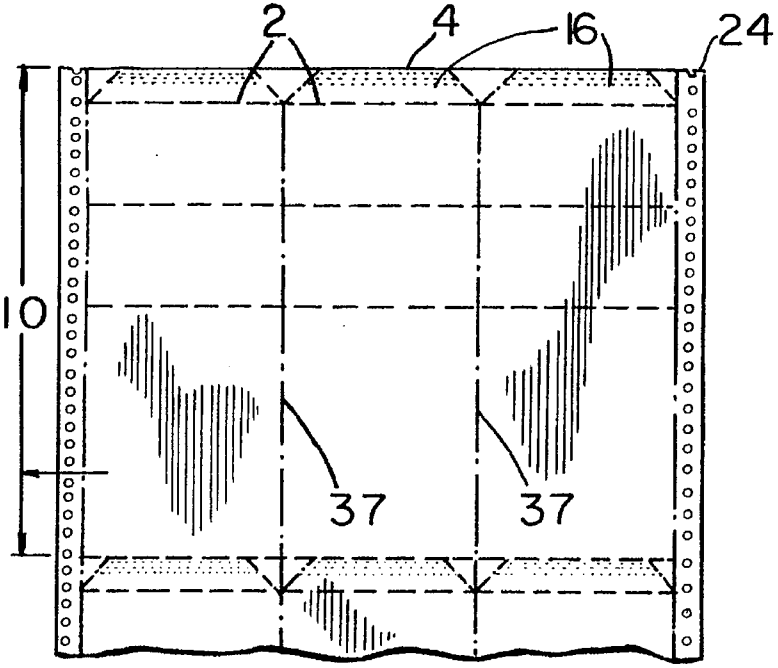
Figure 9:
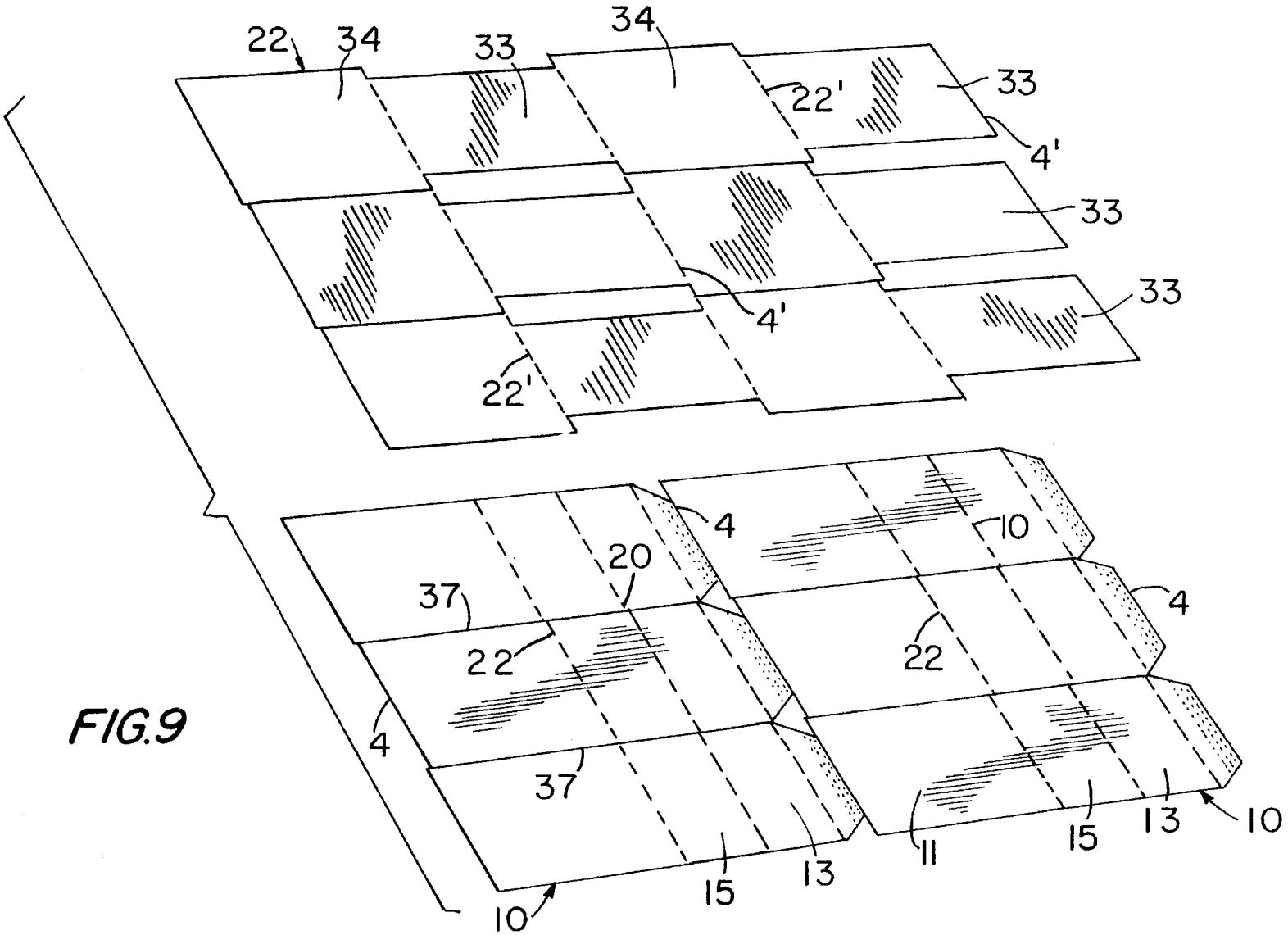
FIG. 9 is an exploded perspective view of the webs of FIGS. 8A and 8B.

In a further preferred embodiment as illustrated in FIGS. 8A and 8B, a second composite sheet 42 comprises a second enclosure device sheet 33, and a third enclosure sheet 34 joined along perforated fold line 22'. The longitudinal edges of each of enclosure device sheets 33 are positioned inside those of enclosure sheets 34. For the purposes of describing the methods of the invention with reference to the embodiment illustration in FIGS. 8A and 8B, the transverse distance between the longitudinal edges of sheet 34 is equivalent to that of envelope sheet 13, and the distance between the longitudinal edges of sheet 33 is the same as that of enclosure sheet 11. Also, the relative positions of the sheets on the respective webs 10 and 10' are the same. Thus, by properly indexing webs 10 and 10', as by use of the line holes 24, the composite sheets 13 and 33 can readily be aligned in a superposed configuration, that is with sheet 34 over sheet 11 and sheet 33 over envelope sheet 13, and the superposed webs thereafter moved as a unit. A liquid or hot melt adhesive is applied at opposite margins 35 of sheet 34 to secure the two webs during further processing.

Prior to this mating step, web 10' can also be printed in accordance with whatever enclosure devices are desired for inclusion in the respective envelopes making up the direct mail article packet. In addition, the second enclosure web 10' can be personalized in the same manner as was the first composite sheet 10 comprising the envelope section and integral enclosure device sheet.

The methods for completing the die-cutting, scoring and folding of the enclosure devices, the gluing and folding of the envelope sections, and the separation of the enclosure devices from the envelope and the trimming of the second and third enclosure sheets is known in the art. These methods are disclosed in detail in, for example, U.S. Pat. Nos. 4,067,161; 4,437,852; 4,543,082; and 4,912,909. These patents disclose methods for producing an envelope containing a plurality of letter sheets, a business reply envelope, various reply devices, such as coupons and the like; and a business reply postcard. The disclosure of these patents are incorporated herein by reference.

Figure 4B:
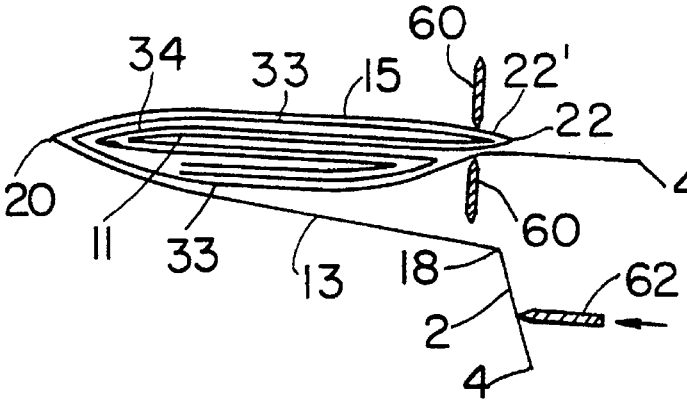

FIG. 4B schematically illustrates the separation of the multiple enclosures from each other and from the rear panel of the envelope, employing the same trimming device described in connection with FIG. 4A.

Once the envelopes have been finished and separated from their respective enclosure devices, they are provided with perforations along parting lines 9, unless such perforations were provided before the folding steps. Perforation lines 9 facilitate their folding, as well as provide for their eventual separation by the recipient.

As previously noted, in order to permit the folding of the envelopes one onto the other, as shown for example in FIG. 6B, and to permit the formation of a compact packet, the width of adjacent envelopes must be varied slightly. The variable width of the envelope, which is defined as the distance between the longitudinal parting lines, must take into account the weight of the paper used, as well as the number and size of the enclosure devices within each envelope. As will be apparent to one familiar with the art, and with reference to FIG. 6B, the width of envelope "C" should be somewhat less than that of envelope "B", and envelope "A" can be of about the same width as envelope "B" or slightly wider depending upon the overall thickness of the enclosures in the envelopes.

The folding configuration of FIG. 6B is preferred, particularly where the number of envelopes exceeds three, since that configuration leaves only one pair of facing envelopes open at one edge. In order to assure the integrity of the packet during mailing and avoid tampering, a wafer seal 47 can be used to secure the open edge of the packet, or releasable adhesive 45 can be applied to join the edges of the envelopes.

What is claimed:

1. A direct mail article comprising a packet of at least three integral finished envelopes, each envelope having an opening sealable by a flap and parallel lateral edges extending downwardly from the opposite ends of the opening, each envelope formed with a folded flap, the lateral edges of the envelopes sealed with adhesive to form pockets, each of the finished envelopes containing at least one separate enclosure device, the envelopes being detachably joined one to the other at their lateral edges along parting lines, and the envelopes being folded at the parting lines inwardly upon each other to superposed the envelopes and form the mailing packet, one side of said packet forming an open edge between the lateral edges of the superposed envelopes, and a wafer seal applied to join the envelopes at the open edge.

2. The article of claim 1 where all of the envelopes are formed from an integral sheet of paper.

3. The article of claim 1 in which all of the envelopes and at least one of the separate enclosure devices in each of the envelopes are produced from the sheet.

4. The article of claim 1 in which at least one of the envelopes and at least one of the enclosure devices are personalized.

5. The article of claim 1 in which the envelopes are detachably joined along a line of perforations.

6. The article of claim 1 in which the width of the envelopes between the parting lines varies.

7. The article of claim 1 in which at least one enclosure device in each of the envelopes is produced from the same integral sheet as the envelopes.

8. The article of claim 1 in which at least one envelope contains a plurality of separate enclosure devices.

9. The article of claim 8 in which the plurality of enclosure devices are produced from at least a second web.

10. The article of claim 1 in which at least one of the envelopes and at least one of the enclosure devices are personalized.

11. The article of claim 10 in which at least one of the separate enclosure devices in each of the envelopes is personalized.

* * * * *

UNITED STATES PATENT AND TRADEMARK OFFICE

CERTIFICATE OF CORRECTION

PATENT NO. : 5,607,100

DATED : March 4, 1997

INVENTOR(S) : John W. Stenner

It is certified that error appears in the above-identified patent and that said Letters Patent is hereby corrected as shown below:

Column 6, line 58 (Claim 1) delete "superposed" and insert --superpose--.

Amend claim 3 to read as follows:

--3. The article of claim 2 [1] in which all of the envelopes and at least one of the separate enclosure devices in each of the envelopes are produced from the same sheet.--

Signed and Sealed this

Ninth Day of September, 1997

*Attest:*

Bruce Lehman

BRUCE LEHMAN

*Attesting Officer*

*Commissioner of Patents and Trademarks*